US005885310A

United States Patent [19]

Minamidate

[11] Patent Number: 5,885,310

[45] Date of Patent: Mar. 23, 1999

[54] CONDENSED EMULSION FUEL MATERIAL AND EMULSION FUEL

[75] Inventor: Makoto Minamidate, 476 Shimomiyata, Hassecho, Miura, Kanagawa, Japan

[73] Assignees: Makoto Minamidate, Kanagawa; Hisayoshi Tanaka, Tokyo; Yutaka Hashimoto, Saitama, all of Japan

[21] Appl. No.: 989,015

[22] Filed: Dec. 11, 1997

[30] Foreign Application Priority Data

Dec. 12, 1996 [JP] Japan ..... 8-332287

[51] Int. Cl.[6] ..... C10L 1/32

[52] U.S. Cl. ..... 44/301; 44/370; 44/435

[58] Field of Search ..... 44/301, 370, 435

[56] References Cited

U.S. PATENT DOCUMENTS

| | | | |
|---|---|---|---|
| 2,077,406 | 4/1937 | Gaertner | 44/301 |
| 2,920,948 | 1/1960 | Weeks | 44/301 |
| 3,490,237 | 1/1970 | Lissant | 44/301 |
| 4,382,802 | 5/1983 | Beinke et al. | 44/301 |
| 4,801,304 | 1/1989 | Polanco et al. | 44/301 |
| 5,000,757 | 3/1991 | Puttock et al. | 44/301 |

*Primary Examiner*—Margaret Medley
*Attorney, Agent, or Firm*—McCormick, Paulding & Huber

[57] ABSTRACT

In the present invention, a solution of synthetic anionic surface active agents is at first prepared by mixing and homogenizing sodium polyoxyethylenealkylether sulfate and sodium alpha-olefin sulfonate (both are anionic surface active agents). Distillated water is added to this solution with mixing such that the mixture becomes a mousse-like emulsion that homogeneously contains a sufficient amount of air bubbles. A condensed emulsion fuel material is then produced by adding petroleum liquid fuel to the mousse-like emulsion with mixing. The concentrated emulsion fuel material and an emulsion fuel has an excellent chemical stability and does not separate to water and oil layers even after a long term storage. In addition, as it can be combusted at a high temperature boiler without requiring so much air, the emission of both soot (dust) and NOx are simultaneously reduced.

4 Claims, 2 Drawing Sheets

| FUEL TYPE | | REQUIRED TIME | FUEL CONSUMPTION |
|---|---|---|---|
| EMULSION | 47.5% | 3 MINUTES AND 17 SECONDS | 179.6 cc |
| WATER | 52.5% | | |
| EMULSION | 50.0% | 4 MINUTES AND 18 SECONDS | 179.0 cc |
| WATER | 50.0% | | |
| KEROSENE | | 8 MINUTES AND 40 SECONDS | 364.0 cc |

CONDENSED EMULSION FUEL MATERIAL AND EMULSION FUEL

BACKGROUND OF THE INVENTION

1. Technical Field

The present invention relates to a novel emulsion fuel that is produced by adding water to petroleum liquid fuel.

2. Background Art

Emulsion-type fuel that is produced by adding water to petroleum liquid fuel is conventionally used in order to reduce soot (dust) and NOx products in exhaust gas of the petroleum liquid fuel.

Such conventional emulsion fuel is produced by adding water (5–30%) and a small amount of surface active agents to hydrophobic liquid fossil fuel such as kerosene with mixing such that they are emulsified. At the combustion of the fuel, water contained in the emulsion fuel dramatically increases its volume (about 1,700 times as much as the original volume) when it quickly becomes steam, and the size of the fuel drops injected from a burner is made very small due to this burst of steam. As a result, a better mixture of fuel and combustion air (thus a better combustion) is achieved and the emission of soot and dust is reduced. In addition, production of NOx is also reduced during the combustion because of a lower flame temperature resulting from evaporation the latent heat of evaporation of water.

However, in the case of the conventional emulsion fuel as described above, it separates into a water layer and an oil layer in a few weeks in a storage tank or the like because the specific gravity of water and that of petroleum liquid fuel is different from each other. Thus, storage of the conventional emulsion fuel for a long period is troublesome.

In addition, as 0.08% of heat is lost against 1% of water mixing in the conventional emulsion fuel. For example, when 20% of water is mixed, about 1.6% of heat is lost. Therefore, the conventional emulsion fuel cannot be used for a boiler in which a high heat efficiency is required.

SUMMARY OF THE INVENTION

The present invention is contrived in order to solve the problems described above in an effective way. Its purpose is to propose a novel condensed emulsion fuel material and emulsion fuel that not only reduces the emission of soot (dust) and NOx but also has excellent stability without separating even in a log-term storage and can be used for a boiler of a high heat efficiency without causing problems.

As an aspect of the present invention, a solution of synthetic anionic surface active agents is at first prepared by mixing and homogenizing sodium polyoxyethylene alkylether sulfate and sodium alpha-olefin sulfonate (both compounds are anionic surface active agents). Distillated water is added to this solution with mixing such that the mixture becomes a mousse-like emulsion that contains air bubbles homogeneously. A condensed emulsion fuel material is then produced by adding petroleum liquid fuel to the mousse-like emulsion with mixing.

In the case of the condensed emulsion fuel material produced as described above by mixing the mousse-like emulsion (the mousse-like emulsion is produced by mixing synthetic anionic surface active agents with distillated water) and petroleum liquid fuel with stirring, the resulting emulsion has an excellent hydrophilicity and an increased volume due to air bubbles created in it by stirring. Therefore, it has a relatively large hydrophilic inner area and thus can contain a larger amount of water than the conventional emulsion. Further, as the relatively large specific gravity of water is compensated by the relatively small specific gravity of the contained air bubbles, the concentrated emulsion of the present invention has approximately the same specific gravity as that of the petroleum liquid fuel. Because of this excellent hydrophilicity and a relatively small specific gravity, the concentrated emulsion fuel material of the present invention can be chemically stable and be stored for a long term (2 to 3 months) without experiencing separation into oil and water layers.

In addition, a unique emulsion fuel is produced by adding water to such concentrated emulsion fuel material having an excellent chemical stability (the amount of water is to be between once and twice as much volume as the concentrated emulsion). The emulsion fuel of this type emits a smaller amount of NOx in its exhaust gas when it is combusted (even if the combustion temperature is relatively high) because it utilizes hydrogen and oxygen that are by-products of water degradation (water is dissolved into hydrogen and oxygen when the combustion temperature is over 1350 Celsius degrees) and thus needs a less amount of combustion air than the conventional one. Also, the emulsion fuel produced from the concentrated emulsion fuel material of the present invention emits a less amount of soot (dust) in its exhaust gas because combustion can be efficiently and completely carried out at a higher flame temperature. It should be noted that an ignition temperature is to be over 400 Celsius degrees because the emulsion fuel contains water of more than 50% volume. However, a continuous combustion is enabled once the fuel is ignited.

In the case of the conventional emulsion fuel, a relatively large portion of water has to be added to the emulsion such that the flame temperature is low enough to curb the emission of NOx in the exhaust gas. However, the resulting large latent heat of water evaporation significantly lowers the heat efficiency to such a degree that the emulsion fuel cannot be used for a boiler having a high heat efficiency.

On the contrary, the emulsion fuel of the present invention can achieve complete combustion of uncombusted fuel using a less amount of combustion air, and thus not only reduces soot and dust due to incomplete combustion but also significantly curbs the emission of NOx (NOx is reduced because less amount of the combustion air is required) even the combustion is carried out at a relatively high temperature.

BRIEF DESCRIPTION OF THE ACCOMPANYING DRAWINGS

DETAILED DESCRIPTION OF THE PREFERRED EMBODIMENTS

Now, a preferred embodiment of the present invention will be described with reference to the accompanying drawings.

A concentrated emulsion fuel material of the present invention is produced as follows. At first, a solution of synthetic anionic surface active agents is prepared by mixing and homogenizing sodium polyoxyethylenealkylether sulfate and sodium alpha-olefin sulfonate. Both sulfonate compounds are anionic surface active agents. Distillated water is added to this solution with mixing such that the mixture becomes a mousse-like emulsion that contains air bubbles homogeneously. A condensed emulsion fuel material of the present invention is then produced by adding an appropriate amount of petroleum liquid fuel to the mousse-like emulsion with stirring.

That is, as for the ingredients, the concentrated emulsion fuel material of the present invention includes a solution of synthetic anionic surface active agents (sodium polyoxyethylenealkylether sulfate and sodium alpha-olefin sulfonate), distillated water, and petroleum liquid fuel material.

Figure 1:
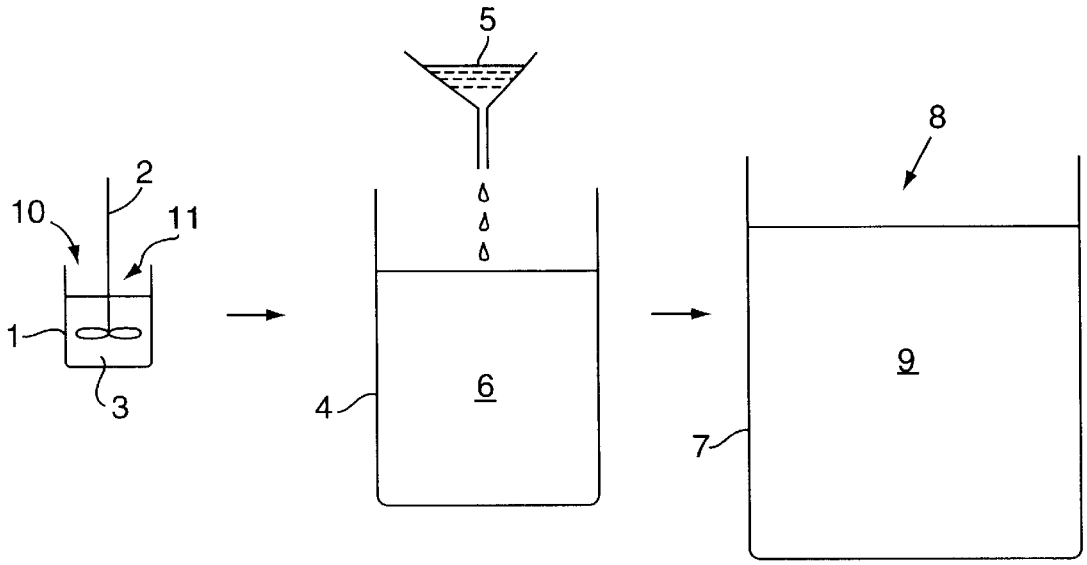
FIG. 1 is a schematic diagram showing an example of production method of the concentrated emulsion fuel material and the emulsion fuel according to the present invention.

Next, an actual example of the production method of the concentrated emulsion fuel material will be described below. As shown in FIG. 1, at a room temperature and under the atmospheric pressure, sodium polyoxyethylenealkylether sulfate and sodium alpha-olefin sulfonate(both are anionic surface active agents 10) are mixed in a beaker 1 such that the mixture ratio of them is 3:1 in volume (30 cc:10 cc, for example). The mixture is homogeneously stirred to produce a solution of the anionic surface active agents. Distilled water 11 of six times as much volume as sodium alpha-olefin sulfonate (60 cc) is gradually and stirringly added to the solution and the mixture is whipped. The whipped mixture is then slowly stirred by a propeller 2 until the mixture becomes like mousse, producing an mousse-like emulsion 3 containing sufficient amount of air bubbles is produced.

At the next stage, the mousse-like emulsion 3 is transferred into a larger container 4 and olefinic unsaturated hydrocarbon 5 (contained in liquid fossil hydrocarbon such as petroleum) of between 150 and 200 times as much volume as the mousse-like emulsion 3 (that is of 15–20 liters) is added to the mousse-like emulsion 3 with stirring such that the whipped state of the mousse-like emulsion 3 be maintained. During this mixture, the olefinic unsaturated hydrocarbon 5 is at first gradually dropped into the mousse-like emulsion 3 such that an emulsion is produced in which the mousse-like emulsion 3 is a continuous phase and the olefinic unsaturated hydrocarbon 5 is a disperse phase. When the dropped amount of the olefinic unsaturated hydrocarbon 5 exceeds the amount of the mousse-like emulsion 3 in the container 4, the olefinic unsaturated hydrocarbon 5 becomes the continuous phase and the mousse-like emulsion 3 becomes the disperse phase. When the dropped amount of the olefinic unsaturated hydrocarbon 5 is further increased, the emulsion reaches a gel state and a concentrated emulsion fuel material 6 that contains about 0.3–0.4% of water is produced. Since this concentrated emulsion fuel material is in a gel state, its composition is stable and thus a long term storage of the emulsion is possible.

Next, the concentrated emulsion fuel material 6 is transferred to a still larger container 7, and water 8 of between once and twice as much volume as the concentrated emulsion fuel material 6 is mixed into the concentrated emulsion 6 with stirring to produce an emulsion fuel 9.

When the emulsion fuel 9 is used as fuel for a boiler, complete combustion of uncombusted fuel with a relatively small amount of combustion air can be achieved. Therefore, the emission of the soot (dust) due to incomplete combustion is reduced and the emission of NOx is also significantly reduced even at a high flame temperature because a less amount of combustion air is required (compared with the prior art).

To demonstrate the above-described effects, the following test was carried out on a concentrated emulsion fuel material and an emulsion fuel according to the present invention.

TEST

At a room temperature and under the atmospheric pressure, 30 cc of sodium polyoxyethylenealkylether sulfate and 10 cc of sodium alpha-olefin sulfonate (both are anionic surface active agents 10) were mixed in a beaker of which volume is about 300 cc. The mixture was homogeneously stirred to produce a solution of the anionic surface active agents. 60 cc of distilled water was gradually and stirringly added to this anionic surface active agent-solution and the mixture was whipped. The whipped mixture was then stirred by a propeller at a low speed (less than 1000 rpm) until the air bubbles got smaller and the mixture became like mousse, producing an mousse-like emulsion containing a sufficient amount of air bubbles.

At the next stage, the mousse-like emulsion is transferred into a larger container and 15 liters of olefinic unsaturated hydrocarbon (contained in liquid fossil hydrocarbon such as petroleum, kerosene, heavy oil and light oil) were added to the mousse-like emulsion with stirring such that the whipped state of the mousse-like emulsion be maintained. As a result, a concentrated emulsion fuel material was produced.

Next, the concentrated emulsion fuel material was transferred to a still larger container, and water of between once and twice as much volume as the concentrated emulsion fuel material was mixed into the concentrated emulsion with stirring to produce about 30–40 liters of white emulsion fuel. Herein, two types of emulsion fuel were prepared (fuel A, fuel B). Fuel A was constituted of 47.5% of the concentrated emulsion fuel material and 52.5% of water. Fuel B was constituted of 50.0% of the concentrated emulsion fuel material and 50.0% of water.

Figure 2:
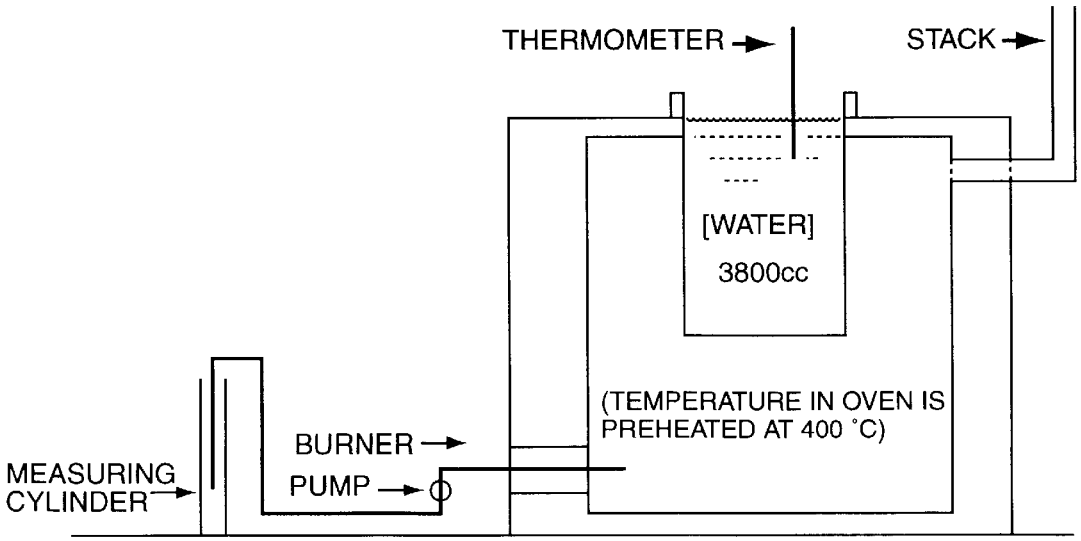
FIG. 2 is an explanatory diagram showing a testing method of the combustion of the emulsion fuel according to the present invention.

Next, an oven as shown in FIG. 2 was preheated such that the temperature inside the oven was kept at 400 Celsius degrees. A container that contained 3.8 liters (3800 cc) of water was provided in the oven and the container was heated using the fuel A, fuel B and kerosene as fuel. Then, the time that was required for heating the water in the container from 26 degrees to 95 degrees (Celsius) and the fuel consumption rate, as well as the amount of soot (dust) emission and the NOx emission were measured for each fuel type.

Figure 3:
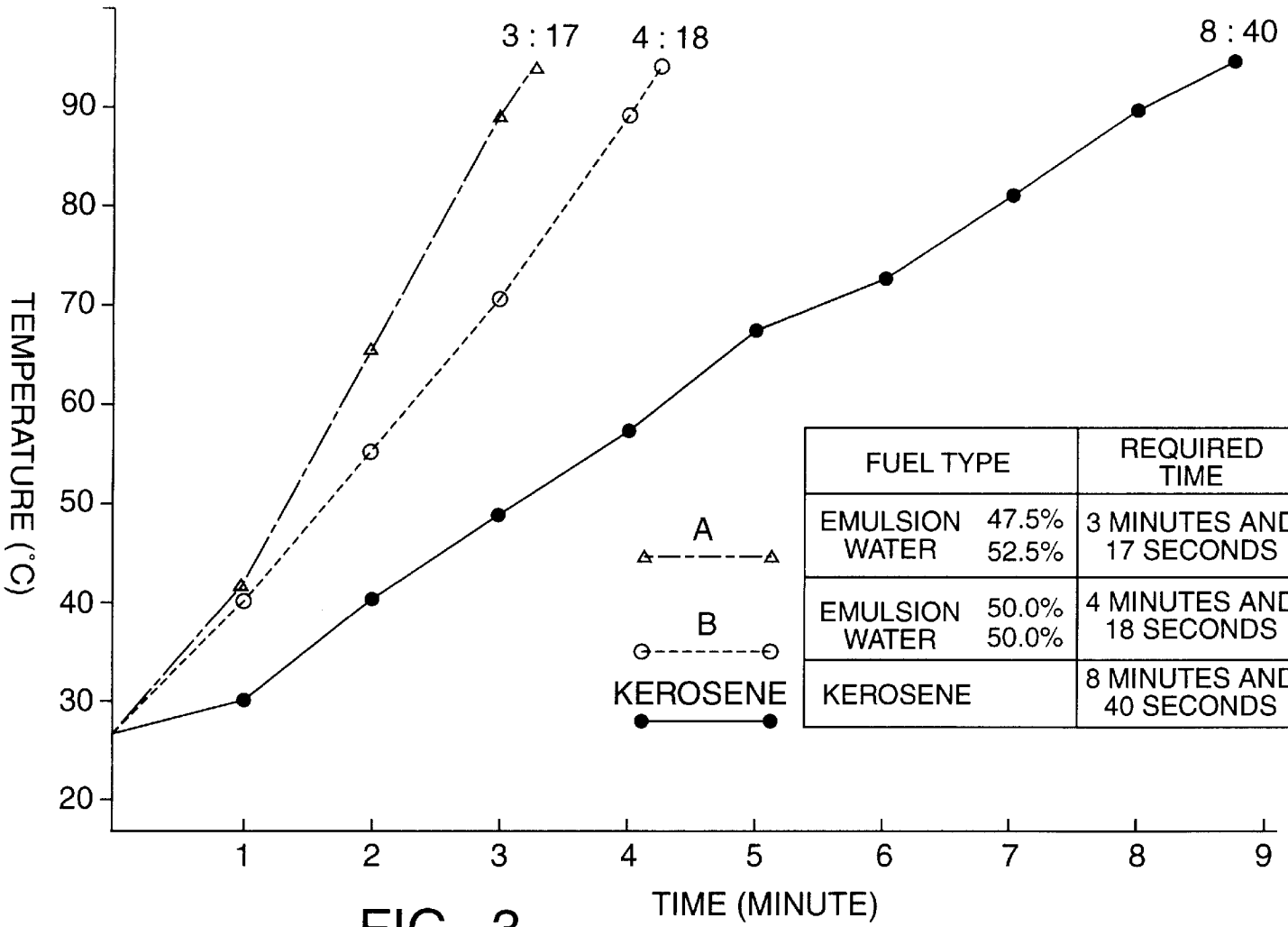
FIG. 3 is a graph showing results of a temperature increase test performed in one embodiment of the present invention in which combustion efficiency is compared between different fuels.

As shown in FIG. 3, when kerosene was used as the fuel, the time required for heating the water in the container put in the oven to the predetermined temperature (95 degrees Celsius) was 8 minutes and 40 seconds and the amount of kerosene consumed during the period was 364 cc. On the other hand, when the emulsion fuel A, B were used as the fuel, the required time and the fuel consumption were both less than a half of those of kerosene. That is, the emulsion fuel A, B demonstrated an excellent combustion efficiency. In addition, the amount of soot (dust) emission and NOx emission in the exhaust gas was also significantly reduced compared with the case using kerosene, further demonstrating a higher combustion efficiency as well as an excellent curbing effects on NOx emission. Further, when the concentrated emulsion fuel material and a conventional emulsion fuel were stored under the same conditions, the conventional emulsion fuel separated into an oil layer and a water layer in two weeks, while the concentrated emulsion fuel material of the present invention did not experience substantial separation or change in its composition even after two months, demonstrating an excellent chemical stability.

According to the present invention, in short, water and petroleum liquid fossil fuel contained in the emulsion fuel are less likely to separate from each other and the chemical stability of the emulsion fuel is significantly improved enabling a long term preservation. In addition, as only a relatively small amount of combustion air is required for achieving a high heating efficiency (because of the utilization of $H_2$ and $O_2$ obtained from $H_2O$), the emission of soot (dust) due to incomplete combustion and the emission of NOx (mainly due to $N_2$ in the combustion air) can be simultaneously reduced.

What is claimed is:

1. A water-in-oil fuel emulsion comprising a whipped mixture consisting of sodium polyoxyethelenealkylether sulfate, sodium alpha-olefin sulfonate, distilled water, air bubbles; and petroleum liquid fuel;

wherein a ratio in volume of said sodium polyoxyethelenealkylether sulfate to said sodium alpha-olefin sulfonate to said distilled water to said petroleum liquid fuel is 3:1:6:1500–2000 wherein the said emulsion has the consistency.

2. A fuel emulsion according to claim 1, further comprising water added to and mixed with said water-in-oil fuel emulsion such that said fuel emulsion results in a ratio in volume of said water to said water-in-oil fuel emulsion of 1–2:1.

3. A method of producing a water-in-oil fuel emulsion comprising the steps of mixing sodium polyoxyethelenealkylether sulfate and sodium alpha-olefin sulfonate and forming an anionic surfactant mixture;

adding distilled water to said anionic surfactant mixture and stirring to form a whipped mixture containing air bubbles; and adding petroleum liquid fuel to said whipped mixture and stirring to form a water-in-oil fuel emulsion, wherein the ratio in volume of said sodium polyoxyethelenealkylether sulfate to said sodium alpha-olefin sulfonate to said distilled water to said petroleum liquid fuel is approximately 3:1:6:1500–2000 wherein the said emulsion has the consistancy of mousse.

4. A method of producing a fuel emulsion according to claim 3, further comprising mixing water to said water-in-oil fuel emulsion, wherein the ratio in volume of said water-in-oil fuel emulsion to said water is approximately 1:1–2.

* * * * *